United States Patent [19]

Rueth, Jr.

[11] 4,297,554

[45] Oct. 27, 1981

[54] TIME DELAY SWITCH MECHANISM

[75] Inventor: William R. Rueth, Jr., Hazel Crest, Ill.

[73] Assignee: G & W Electric Specialty Company, Blue Island, Ill.

[21] Appl. No.: 114,742

[22] Filed: Jan. 24, 1980

[51] Int. Cl.[3] ..... H01H 7/03

[52] U.S. Cl. ..... 200/153 SC; 200/34; 200/318; 337/5

[58] Field of Search ..... 200/34, 48 R, 153 SC, 200/6, 318, 325; 337/5, 143, 148, 150, 402

[56] References Cited

U.S. PATENT DOCUMENTS

| | | | |
|---|---|---|---|
| 2,663,775 | 12/1953 | MacNeill et al. | 200/34 |
| 2,809,252 | 10/1957 | Lingal et al. | 200/34 |
| 2,881,285 | 4/1959 | Bank | 200/34 |
| 2,995,043 | 8/1961 | Lusk et al. | 74/97 |
| 3,164,693 | 1/1965 | Nicholas et al. | 200/48 R |
| 3,211,870 | 10/1965 | Lusk et al. | 200/153 L |
| 3,519,970 | 7/1970 | Lusk et al. | 337/5 |

*Primary Examiner*—John W. Shepperd

*Attorney, Agent, or Firm*—Fitch, Even, Tabin, Flannery & Welsh

[57] ABSTRACT

A high voltage switch having a snap-action switching mechanism for effecting opening and closing of relatively movable switch contacts, and having mechanical time delay trip release mechanism operatively associated with the switching mechanism to effect a selected time delayed opening of the switch contacts in response to a predetermined event such as a current overload. The time delay trip release may also be manually actuated to open the switch contacts from a closed condition.

16 Claims, 7 Drawing Figures

TIME DELAY SWITCH MECHANISM

The present invention relates generally to switch mechanisms, and more particularly to a switch mechanism which finds particular application in high voltage switches and which employs novel mechanical time delay trip release mechanism operative to effect a selective time delay between actuation of the trip release and opening of associated switch contacts from a closed condition.

Electric switch apparatus are known which employ relatively movable contacts disposed within a liquid dielectric filled tank or container for high voltage operation, and wherein spring energized toggle mechanism is provided to effect snap-action movement of the switch contacts between relative open and closed positions. See, for example, U.S. Pat. No. 3,519,970, issued July 7, 1970, and assigned to the assignee of the present invention. In the switch apparatus disclosed in U.S. Pat. No. 3,519,970, a trip lever and associated toggle linkage arrangement are operatively associated with a locking plate member having direct connection to movable contacts so that actuation of the trip lever in response to a current overload or fault current actuates the switch into an open circuit condition. Provision is also made for manually tripping the trip lever so as to open the switch contacts from a closed condition.

When operating high voltage switches, it is sometimes convenient or necessary to incorporate a time delay between actuation of the switch trip mechanism and opening of the switch contacts from a closed circuit condition. One conventional approach to implementing a time delay in a switch mechanism is to incorporate an electrical timer and a solenoid operated trip linkage. A significant drawback in this type of design is that it requires relatively expensive components and also relies on an external source of electrical power.

One of the primary objects of the present invention is to provide a high voltage switch employing novel time delay mechanism for effecting selective time delay between actuation of a trip mechanism and opening of switch contacts from a closed circuit condition, which time delay mechanism is relatively economical and operates independently of an external source of electrical power.

A more particular object of the present invention is to provide a high voltage switch mechanism employing a novel time delay mechanism operatively associated with the locking plate of a spring energized switch transfer mechanism and adapted to effect a time delay between the happening of a predetermined event, such as a current overload or fault current, and actuation of the spring energized transfer mechanism through a snap-action movement to open the contacts of the switch.

Another object of the present invention is to provide a high voltage switch which employs a novel mechanical time delay having a toggle trip mechanism operative between a first armed condition in which an actuating lever is spring loaded preparatory to releasing potential energy to the toggle trip and a second released condition during which the spring loaded actuating lever actuates the toggle trip so as to release a latching lever to enable switch opening, the spring loaded actuating lever having a dash pot operatively associated therewith in a manner to control the rate of energy transfer from the actuating lever to the toggle trip so that a predetermined time delay is effected between tripping of the toggle trip and release of a locking plate to enable swich opening.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
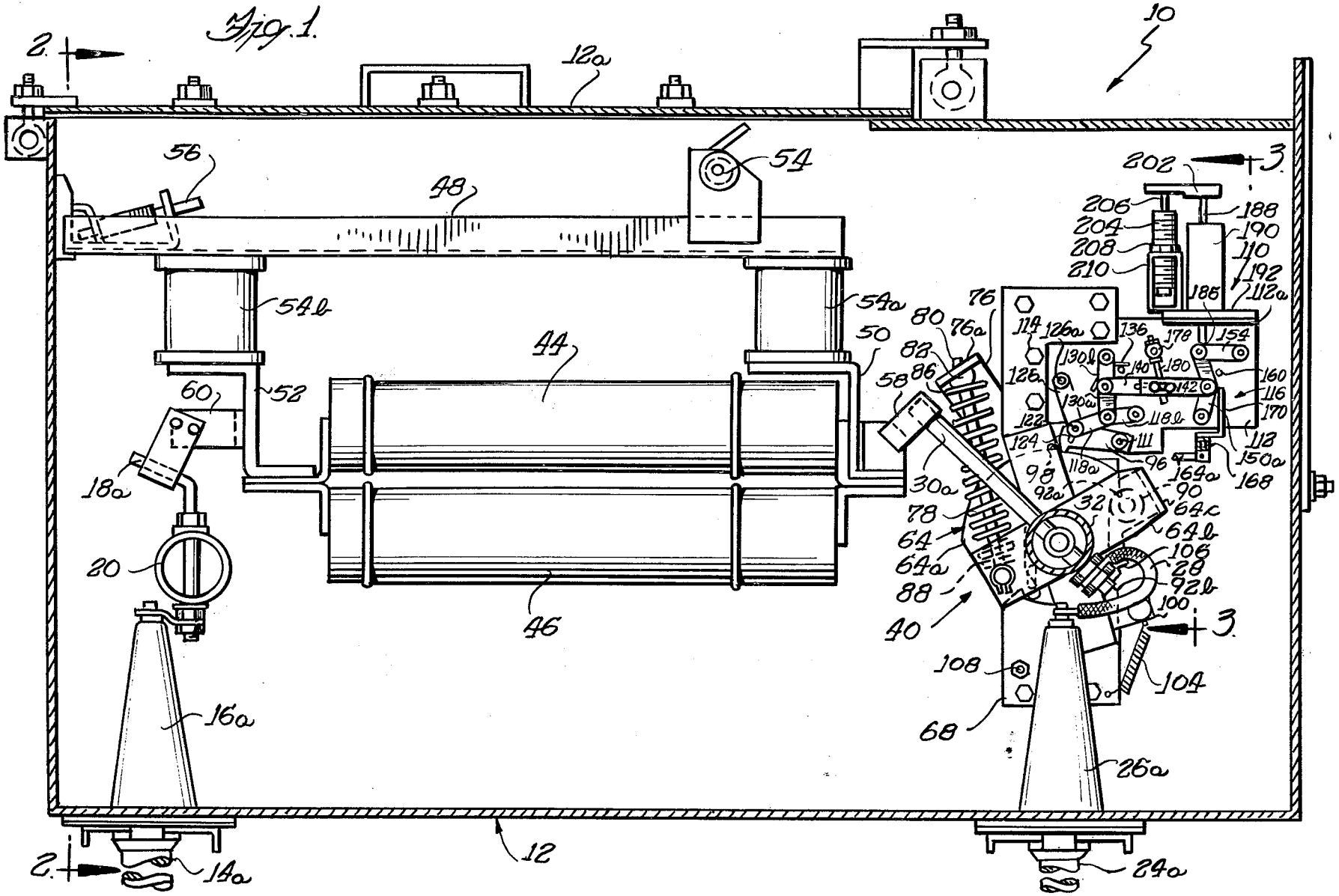
FIG. 1 is a vertical sectional view taken through a high voltage switch embodying the present invention.
Figure 2:
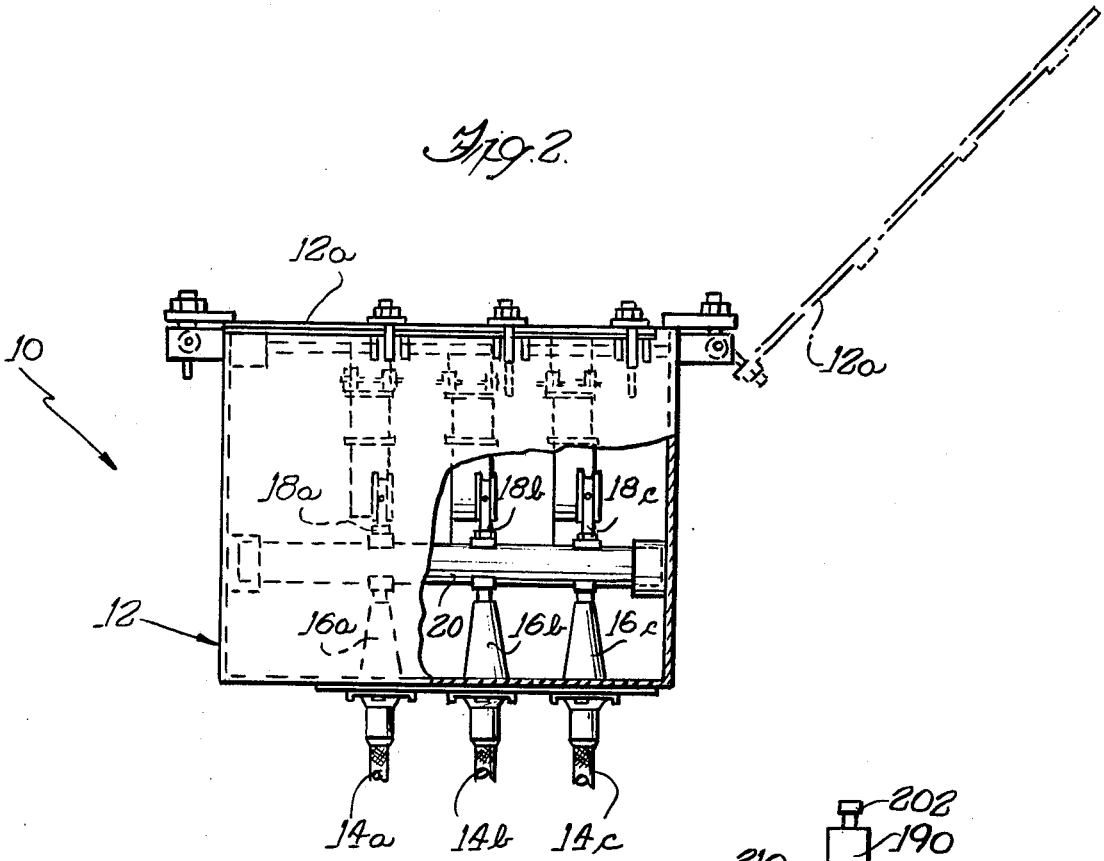
FIG. 2 is a transverse sectional view, taken substantially along line 2—2 of FIG. 1 but on a reduced scale, illustrating the three fixed contacts of the 3-phase switch.

Referring now to the drawings, and in particular to FIGS. 1 and 2, an electrical switch embodying the present invention is indicated generally at 10. The switch 10 to be hereinafter described comprises a high voltage switch having a generally rectangular tank or container 12 adapted to contain oil or other suitable liquid dielectric medium. The tank 12 may have a hinged cover plate **12*a* adapted to be opened as illustrated in FIG. 2** to facilitate access to and servicing of internal components, as well as enabling removal of the internal components from the container tank. The cover plate is adapted to be closed and locked in sealed relation on the tank by locking nuts or other suitable means located in spaced relation around the periphery of the cover plate.

The illustrated high voltage switch 10 is for use in a three phase circuit and, to that end, has the terminal ends of three insulated conductors **14*a*, 14*b* and 14*c* received through suitable openings in the bottom wall of the container tank and sealed therein by terminal insulators 16*a*, 16*b* and 16*c*, as is known. Each conductor 14*a*, 14*b* and 14*c* has a fixed switch contact 18*a*, 18*b* and 18*c*, respectively, connected thereto, the fixed contacts being supported on a transverse bar 20 having its opposite ends mounted to the laterally opposed side walls of the container tank 12**.

Three insulated supply conductors **24*a*, 24*b* and 24*c*, only one of which is shown at 24*a* in FIG. 1, having paired relation with the conductors 14*a*, 14*b* and 14*c*, respectively, are received through suitable openings in the lower or bottom wall of the container 12 and are terminated in insulators, one of which is shown at 26*a*, which provide sealed relation with the container. The terminal end of each of the supply conductors 24*a*, 24*b* and 24*c* is connected through a flexible conductor 28 to an associated contact rod, indicated at 30***a*, 30*b* and 30*c* in FIG. 3, which together define the movable switch contacts of the high voltage switch 10. The contact rods 30*a*, 30*b* and 30*c*, which may hereinafter be referred to collectively as the movable contact rods 30, are mounted on and project radially from a transverse insulated support shaft 32 having one end journaled at 34 to one side wall of the container tank and having its opposite end fixedly secured at 36 to a spring energized switch actuating or transfer mechanism indicated generally at 40.

In the illustrated embodiment, the fixed switch contacts 18*a*, 18*b* and 18*c* are adapted to be connected in closed circuit with corresponding ones of the movable contact rods 30 30*a*, 30*b* and 30*c*, respectively, through corresponding pairs of current limiting fuses 44 and 46 in a manner as disclosed in the aforementioned U.S. Pat. No. 3,519,970 which is incorporated herein by reference. Briefly, one or two fuses may be provided for each phase of the electric circuit in which the switch 10 is connected. Each pair of current limiting fuses 44 and 46 in the illustrated embodiment is mounted on a carriage in the form of a supporting channel 48 through a pair of contact supports 50 and 52 and standoff insulators 54*a* and 54*b*. Each supporting channel 48 is pivotally mounted at one end on a transverse pivot shaft 54 to enable selective pivotal movement of the pairs of fuses 44 and 46 outwardly of the container tank 12 when the cover plate 12*a* is opened, each supporting channel 48 having its end opposite its pivotal connection 54 adapted for releasable locking within the container tank through spring locking means 56. Each of the contact supports 50 has a bifurcated contact 58 connected thereto for releasably receiving the associated contact rod 30*a*, 30*b* or 30*c* is closed circuit relation therewith, while each contact support 52 has a bifurcated contact 60 fixed thereon for coaction with the associated fixed switch contact 18*a* 18*b* or 18*c* when the pairs of current limiting fuses 44 and 46 are disposed in operating position within the container tank 12.

It will be appreciated that with the respective pairs of current limiting fuses 44 and 46 disposed in operating position within the container tank 12, and with the movable contact rods 30 being in closed circuit relation with the contacts 58, the respective pairs of conductors 14*a* and 24*a*, 14*b* and 24*b*, and 14*c* and 24*c* are in closed circuit relation, while movement of the contact rods 30 to positions removed from their respective contacts 58 establishes an open circuit condition. Preferably, an interlock (not shown) is provided, such as disclosed in the aforementioned U.S. Pat. No. 3,519,970, to prevent actuation of the movable contact rods 30 to a closed circuit condition when the cover plate 12*a* is open. Locking means (not shown) are also preferably provided for locking the cover plate 12*a* in closed position when the movable contact rods 30 are in closed circuit relation with their corresponding fixed contacts 18*a*, 18*b* and 18*c*.

Figure 3:
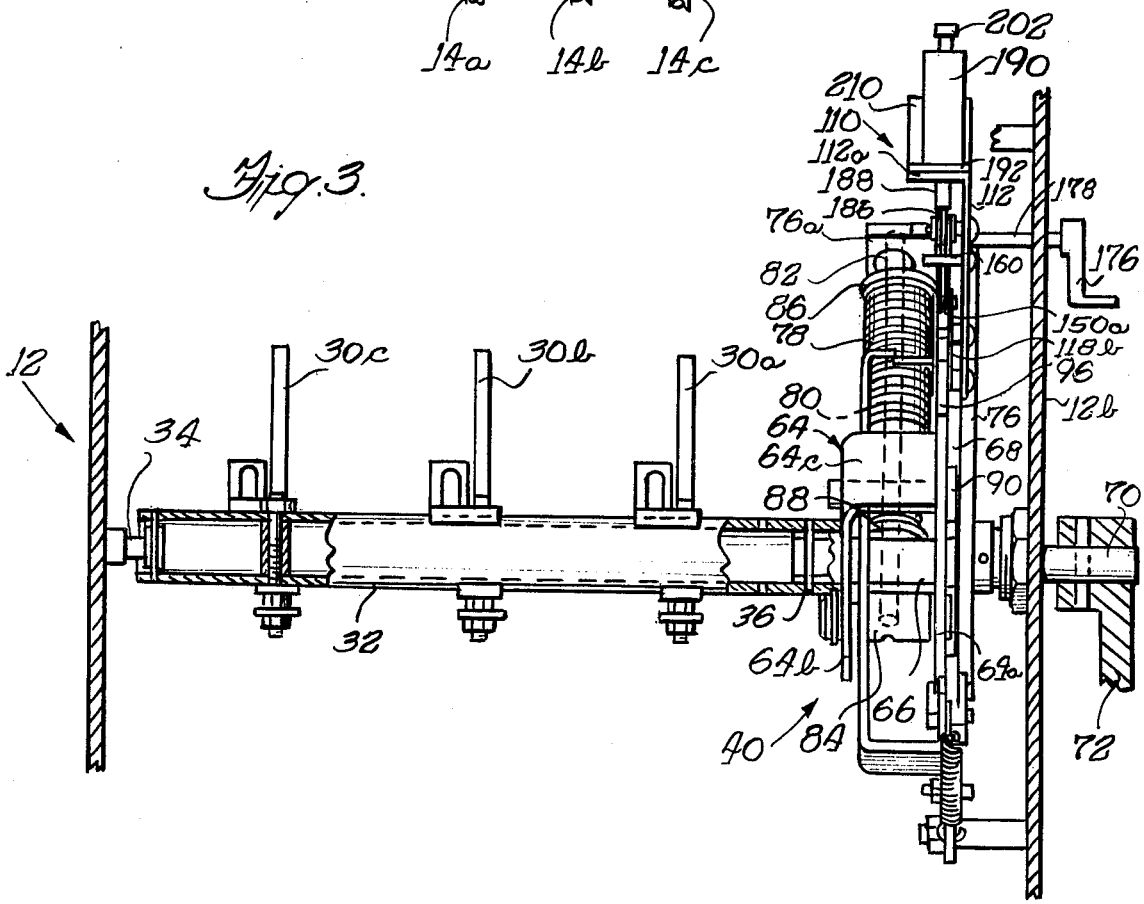
FIG. 3 is a fragmentary transverse sectional view, taken substantially along line 3—3 of FIG. 1, illustrating the movable switch contacts and associated switching and time delay trip mechanism.

The spring energized switch transfer mechanism 40 is adapted to effect snap-action movement of the movable contact rods 30 between open and closed circuit positions relative to the contacts 58 in similar fashion to the snap-action movement of the movable switch contacts disclosed in U.S. Pat. No. 3,519,970. To this end, the spring energized switch transfer mechanism 40 includes a locking plate, indicated generally at 64, having a generally circular plate portion 64*a* interconnected to a parallel leg portion 64*b* through a connecting web 64*c*, as illustrated in FIGS. 1 and 3. The locking plate 64 is fixed on a cylindrical sleeve bearing 66 which is journaled on a support plate 68 mounted on and spaced inwardly from an outer wall 12*b* of the container tank. A shaft 70 is rotatably received within the sleeve bearing 66 and extends outwardly through a suitable support bearing in the wall 12*b* for receiving a crank handle 72 thereon to facilitate manual energizing or arming of the switch transfer mechanism 40 as will become more apparent hereinbelow. The sleeve bearing 66 is coaxial with and connected to the contact rod support shaft 32 so that movement of the locking plate 64 effects a corresponding rotational movement of the support shaft 32.

An L-shaped cocking lever 76 is mounted on and fixed to the shaft 70 so that movement of shaft 70 effects a corresponding movement of the cocking lever. The outer end of cocking lever 76 is interconnected to the locking plate 64 through a power coil spring 78 mounted coaxially on a guide rod 80 which has a spherical ball 82 fixed thereon to seat against a suitable recess within an arm portion 76*a* of the cocking lever so that the guide rod is fixed axially relative to the cocking lever. The opposite end of the guide rod 80 is received through and slidable relative to a collar 84 journaled between the plate portion 64*a* and leg portion 64*b* of locking plate 64. One end of the power spring 78 engages a spring seat 86 against the spherical ball 82 while the opposite end of the power spring seats within a spring seat 88 which is slidable on the guide rod 80 and urged by the power spring against the collar 84.

Figure 5:
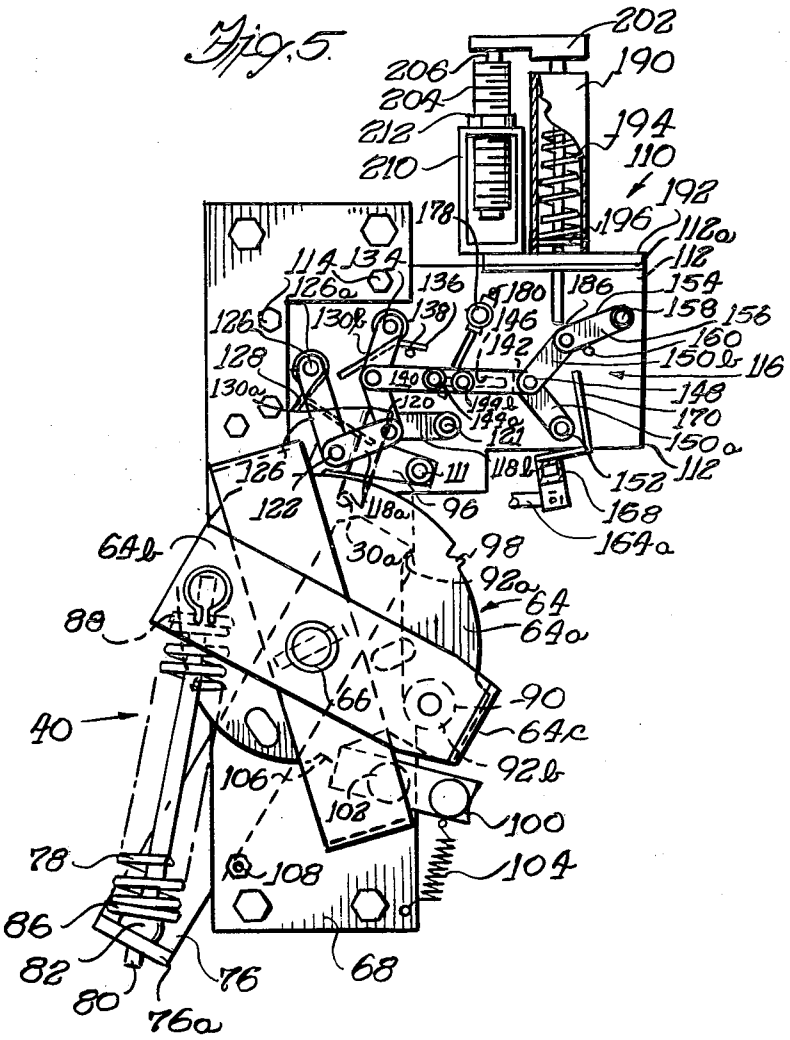
FIG. 5 is an elevational view similar to FIG. 4 but showing the trip and time delay mechanism in a condition wherein the switch contacts are in open circuit relation.
Figure 4:
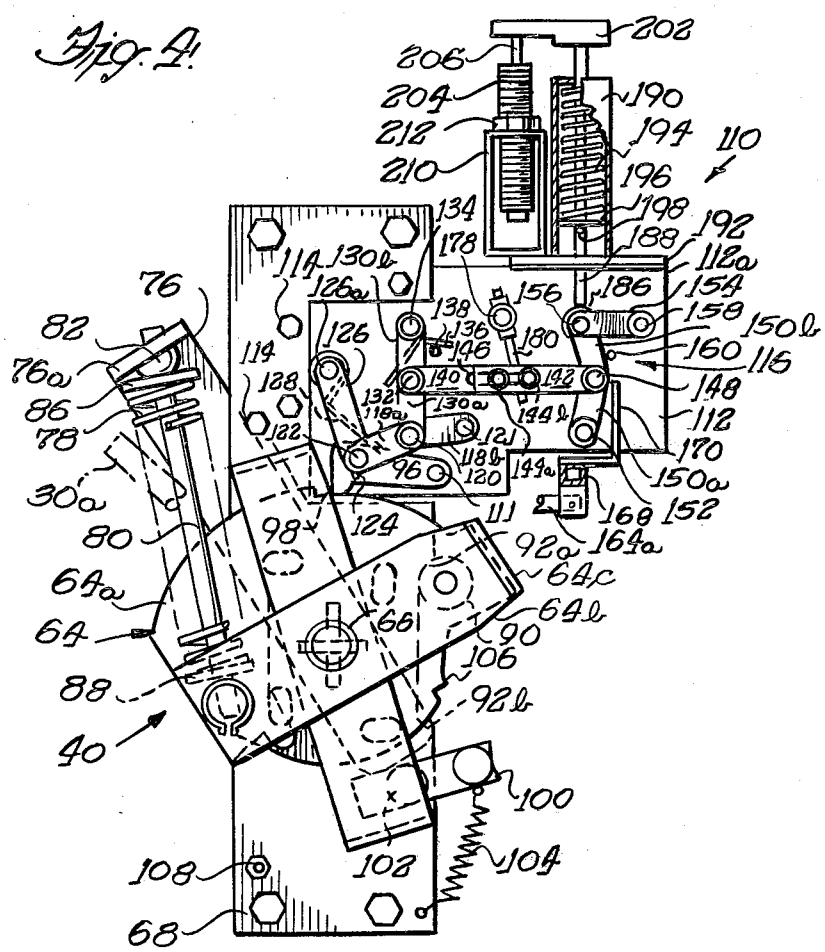
FIG. 4 is an elevational view illustrating the spring energized trip and time delay mechanism in a condition wherein the movable switch contacts are in closed circuit relation.

In the illustrated embodiment, the locking plate 64 carries a stop pin or shaft 90 which extends outwardly from the plate portion 64*a* and is cooperable with stop surfaces 92*a* and 92*b* formed on support plate 68 to limit the extent of rotation of the locking plate about the axis of the shaft 70, as best seen in FIGS. 4 and 5. The locking plate 64 is adapted to be selectively and releasably locked to prevent rotation thereof during compression of the power spring 78, as during cocking or arming of the transfer mechanism 40, by a first latching lever 96 which is cooperable with a ratchet tooth 98 formed on plate portion 64*a* so as to prevent clockwise rotation of the locking plate, as considered in FIG. 4. A second latching lever 100 is pivotally mounted at 102 on the support plate 68 and is urged by a tension spring 104 to a position wherein the free end of lever 100 engages the peripheral edge of plate 64*a* and cooperates with a ratchet tooth 106 formed on plate 64*a* so as to prevent rotation of locking plate 64 in a counterclockwise direction, as considered in FIG. 5, when the contact rods 30 are in open circuit positions.

In the operation of the spring energized switch transfer mechanism 40 thus far described, and assuming the switch transfer mechanism to be in a condition wherein the contact rods 30 are in closed circuit engagement with the switch contacts 58 as illustrated in FIGS. 1 and 4, manual rotation of the crank handle 72 in a counterclockwise direction will effect movement of the cocking lever 76 to a position wherein the cocking lever passes over center relative to the rotational axis of locking plate 64, and the power spring 78 is thereby compressed preparatory to switch transfer. The extent of counterclockwise movement of the cocking lever 76 during compression of spring 78 is limited by a stop pin 108 mounted on plate 68. During initial compression of spring 78, the locking plate 64 is prevented from rotating in a counterclockwise direction by engagement of stop pin 90 with stop surface 92*a*, while rotation of plate 64 in a clockwise direction after the cocking lever 76 passes over center is prevented by latch lever 96 engaging tooth 98. When latch lever 96 is released, the locking plate 64 undergoes a snap-action rotational movement to a position as shown in FIG. 5 wherein stop pin 90 engages stop surface 92*b* and the contact rods 30 are disengaged from the switch contacts 58 to effect an open circuit condition of switch 10. At this point, the locking plate 64 is prevented from rotating in a counterclockwise direction by the latch lever 100 cooperating with ratchet tooth 106 in the locking plate.

In a similar manner, snap-action movement of the contact rods 30 into closed circuit relation with the contacts 58 from an open circuit condition is effected by rotating the crank handle 72 in a clockwise direction, as considered in FIG. 5, to rotate the cocking lever 76 counterclockwise to a position over center relative to a plane containing the axes of shaft 70 and collar 84. During such movement of cocking lever 76, a cam surface 76*b* formed on the cocking lever opposite end 76*a* releases the latching lever 100 from the ratchet tooth 106 to enable snap-action movement of the locking plate and contact rods 30 to closed circuit positions.

As aforenoted, it is sometimes necessary and desirable in the operation of high-voltage switches to incorporate a time delay between the time the spring energized switch transfer mechanism 40 is actuated and the time the switch contacts actually open. One important feature of the present invention is to provide mechanical time delay means, indicated generally at 110, in cooperative relation with the latching lever 96 so as to effect a selected time delay between opening of the switch contacts 30 and a predetermined event such as a current overload as detected by one or more of the pairs of current limiting fuses 44 and 46.

With particular reference to FIGS. 4 and 5, taken in conjunction with FIGS. 1 and 3, the latch lever 96 is pivotally mounted at 111 on a mounting plate 112 which, in the illustrated embodiment, is mounted on the support plate 68 through screws 114 or other suitable means so that the latch lever 96 is substantially coplaner with the plate portion 64*a* of locking plate 64. With the switch contacts 30 in closed circuit condiion with contacts 58, as in FIGS. 1 and 4, the latch lever 96 is maintained in latched relation with the ratchet tooth 98 so as to prevent movement of locking plate 64 and associated switch contacts 30 to an open circuit condition by a toggle linkage arrangement indicated generally at 116, which forms part of the time delay means 110. The toggle linkage arrangement 116 includes a pair of equal length toggle links 118*a* and 118*b* pivotally connected to each other through a pivot pin 120. Toggle link 118*b* is pivotally connected at 121 to plate 112, while link 118*a* has its opposite end connected to latch lever 96 through a connecting pin 122 which is received through an elongated slot or opening 124 in the latch lever 96. The pivot pin 122 also pivotally connects link 118*a* to one end of a pivot link 126 which has its opposite end pivotally connected to plate 112 at 126*a*. During operation, the pivotal connection 120 of toggle links 118*a* and 118*b* remains slightly above a plane containing pivot axes 121, 122 such that links 118*a*, 118*b* are not in axial alignment, as illustrated. The latch lever 96 is urged against the edge of locking plate portion 64*a* by a wire spring member 128 mounted on pivot pin 126*a* and cooperable with toggle link 126.

Another pair of equal length toggle links 130*a* and 130*b* are pivotally connected to each other through a pivot pin 132 and have their opposite ends pivotally connected, respectively, to pivot pin 120 and the mounting plate 112 at 134. The toggle links 130*a*, 130*b* are such that when the latch lever 96 is in latched relation with ratchet tooth 98, as illustrated in FIG. 4, toggle links 130*a*, 130*b* are substantially axially aligned. A wire spring member 136 is coiled about pivot pin 134 and has spring arms engaging, respectively, a fixed pin 138 on a plate 112 and the pivot pin 132 so as to urge the toggle links 130*a*, 130*b* toward their axially aligned positions.

Release of latch lever 96 from its latched relation with ratchet tooth 98 is effected by moving the pivot pin 132 to the left, as considered in FIGS. 4 and 5, so as to cause an upward movement of pivot pin 120 and a corresponding raising of the latch lever a distance sufficient to release it from the ratchet tooth 98 and enable rotation of the locking plate 64 under the energy of the compressed power spring 78. To this end, control linkage means including a control link 140, which may comprise a pair of parallel spaced link members only the outer one of which is seen in FIGS. 4 and 5, is pivotally connected to the pivot pin 132 and has a lost motion connection with a second control link 142 which may also comprise a pair of parallel laterally spaced link members. Control links 140 and 142 are interconnected through a pair of parallel spaced pins 144*a*, 144*b* carried by the control link 142 and received through elongated slots 146 formed longitudinally in the link members comprising control link 140 so that the control links 140 and 142 are adapted for selective lost motion when moved longitudinally relative to each other. The control links 140 and 142 thus define a lost motion control linkage as will be described.

The end of control link 142 opposite its connection to control link 140 is pivotally connected to a pivot pin 148 which pivotally interconnects a pair of equal length toggle links 150*a* and 150*b*. The toggle links 150*a* and 150*b* have their ends opposite their pivotal connection 148 pivotally connected, respectively, to the mounting plate 112 at 152 and to a pivot link 154 through a pivot pin 156 so that the toggle links 150*a*, 150*b* are generally parallel to toggle link 130*a*, 130*b*. The pivot link 154 is, in turn, pivotally connected at 158 to the mounting plate 112. A stop pin 160 is mounted on plate 112 for engagement with toggle link 150*b* so as to establish a right-hand limit for movement of the toggle links 150*a*, 150*b* and control links 140, 142, as considered in FIG. 4, wherein the pivotal connection 148 is to the right of a plane containing the pivot axes 152, 156. In this condition, the toggle linkage arrangement 116 is armed preparatory to a switch transfer operation.

Figure 6:
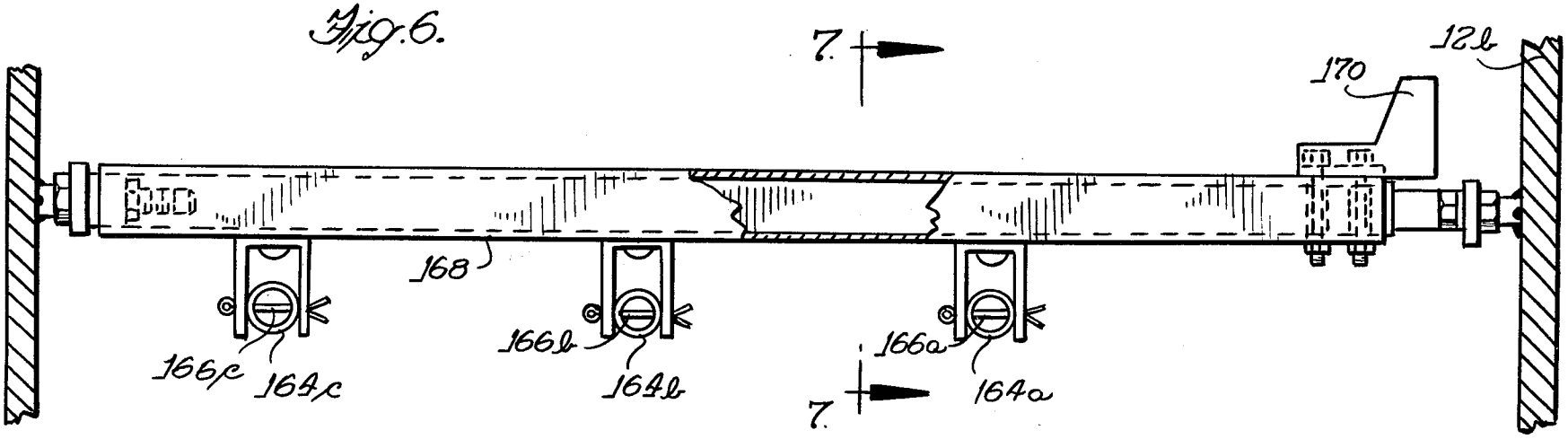
FIG. 6 is a fragmentary transverse sectional view illustrating the time delay trip release shaft.
Figure 7:
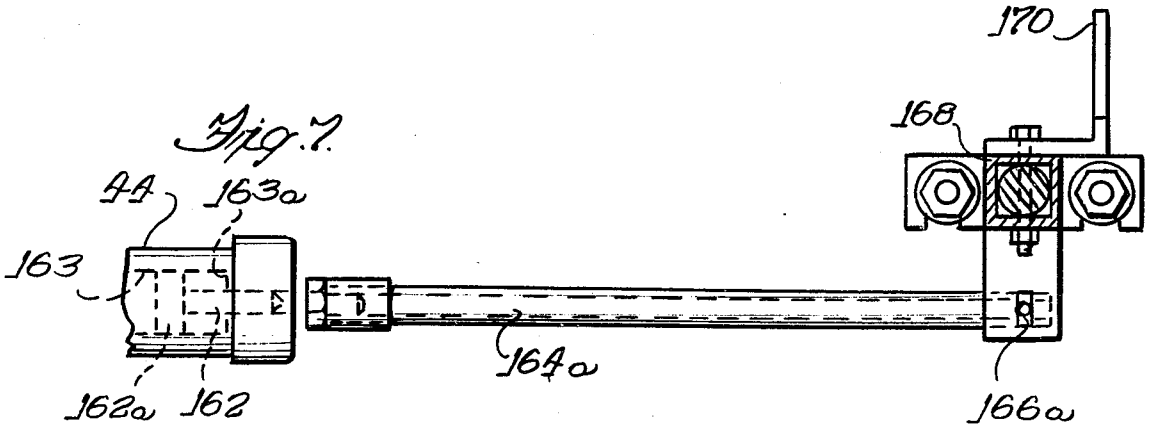
FIG. 7 is a fragmentary detail view, taken substantially along line 7—7 of FIG. 6, illustrating the trip shaft and associated tripping lever for automatically tripping the time delay.

In the preferred embodiment, the latch lever 96 is adapted to be released to enable movement of the switch contact rods 30 to open circuit conditions in response to the occurance of a predetermined event, such as detection of an overload or fault current by one or more of the pairs of fuses 44 and 46, or by the operator manually tripping the latch lever 96. In either case, the latch lever 96 is actually released from the ratchet tooth 98 only after a preselected time delay following the occurance of the predetermined event or manual actuation of trip means by the operator. With particular reference to FIGS. 6 and 7, taken in conjunction with FIGS. 1, 4 and 5, at least one fuse of each pair of fuses 44 and 46, such as fuse 44, is provided with an actuating pin 162 (FIG. 7) received within a suitable longitudinal bore 163 in the fuse and adapted to be propelled outwardly by a powder charge when the fuse 44 melts due to an overload or fault current in the associated electric circuit, such as described in the aforementioned U.S. Pat. No. 3,519,970. Fuses of this type are of known design.

To facilitate automatic release of latch lever 96 when one or more of the fuses 44 is subjected to an overload or fault current greater than the fuse rating, three striker rods 164*a*, 164*b* and 164*c* are suitably supported within tank 12 for longitudinal movement so that each striker rod is in substantially longitudinal alignment with a corresponding fuse 44 and is adapted to have one end engaged by the corresponding actuating pin 162 when projected from its fuse 44. The end of each striker rod 164*a*, 164*b* and 164*c* opposite its corresponding fuse 44 is eccentrically pivotally connected at 166*a*, 166*b* and 166*c*, respectively, to a transverse rectangular pivot shaft 168 journaled between the upstanding front and rear walls of the container tank 12, as illustrated in FIG. 6. Projection of an actuating pin 162 from its associated fuse 44 causes a trip lever 170 on pivot shaft 168 to be rotated so as to engage the pivotal connection 148 of toggle links 150*a*, 150*b* and move the toggle links 150*a*, 150*b* from their positions illustrated in FIG. 4, termed an "armed" condition, to an over-toggle position so that the toggle links 150*a*, 150*b* initiate movement of the control link 142 toward the left, as considered in FIGS. 4 and 5.

Outward movement of the actuating pins 162 from their respective fuses 44 is limited so that the striker rods 164*a*, 164*b* and 164*c* move longitudinally only far enough to move the pivotal connection 148 of toggle links 150*a*, 150*b* to the left through and slightly past a plane containing the pivot axes 152 and 156, that is, to an over-toggle position. To this end, each actuating pin 162 may have an enlarged diameter end 162*a* formed thereon which engages the end 163*a* of the bore 163 in which the actuating pin is disposed, as illustrated in FIG. 7, when the actuating pin has been projected axially outwardly from its associated fuse a predetermined distance.

As noted, the toggle linkage arrangement 116 of the time delay means 110 is shown in an "armed" condition in FIGS. 1 and 4 with the movable switch contacts 30*a*, 30*b* and 30*c* in closed circuit relation with their respective fixed contacts 58, the switch contacts being maintained in such closed condition by latch lever 96. FIG. 5 illustrates the toggle linkage arrangement 116 in an over-toggle or "released" switch transfer condition wherein the latch lever 96 has been released from the tooth 98 on locking plate 64 enabling opening of switch contacts 30 from their associated fixed contacts 58. After release of latch lever 96 from locking plate 64 during a switch opening operation, the latch lever is urged against the peripheral surface of locking plate portion 64*a* by spring 128 so that actuation of the switch transfer mechanism 40 to effect closing of the movable contacts 38*a*, 38*b* and 38*c* into the contacts 58 will cause the latch lever 96 to again cooperate with the tooth 98 and maintain the switch contacts in closed relation as the switch transfer mechanism 40 is subsequently armed preparatory to opening of the switch contacts.

In order to "arm" the toggle linkage arrangement 116 of the time delay means 110, an arming or reset lever 176 is fixed on the outer end of an arming shaft 178 which is journaled on the mounting plate 112 and extends outwardly through the container tank wall 12*b* in sealed relation therewith, as illustrated in FIGS. 1, 2, 4 and 5. An actuating rod 180 is fixed on the inner end of the arming shaft 178 so that the actuating rod extends downwardly parallel to the mounting plate 112 and between the spaced pins 144*a*, 144*b*. Assuming the toggle linkage arrangement 116 to be in a released condition as illustrated in FIG. 5, manual movement of the reset lever 176 and associated arming shaft 178 in a counterclockwise direction, as considered in FIG. 5, causes the actuating rod 180 to engage the pin 144*b* and move the control link 142 in a right-hand direction so as to move the toggle links 150*a*, 150*b* to their aforedescribed armed condition wherein the toggle link 150*b* engages the stop pin 160. The elongated slots 146 within the link members comprising control link 140 are configured so that when the control link 142 is moved to arm the toggle links 150*a*, 150*b*, the pin 144*b* reaches the end of slot 146 and moves the control link 140 in a right-hand direction, thereby moving the toggle links 130*a* and 130*b* to a position wherein they are in substantially longitudinal alignment allowing the latch lever 96 to engage the plate portion 64*a* of locking plate 64.

In addition to providing means for manually arming the toggle linkage arrangement 116 of the time delay means 110, the manual reset lever 176 also enables selective actuation of the toggle linkage arrangement 116 so as to manually initiate a time-delayed switch transfer of the switch contacts 30*a*, 30*b* and 30*c* to open circuit conditions relative to their associated fixed contacts 58. Such manual initiation of a switch transfer operation is effected by rotating the arming lever 176 in a clockwise direction, as considered in FIGS. 4 and 5, so as to cause the actuating rod 180 to engage pin 144*a* and move the control link 142 to a position wherein the pivotal connection 148 of the toggle links 150*a*, 150*b* moves just through a plane containing the pivot axes 152, 156 or to an over-toggle position. The elongated slots 146 are of sufficient length so that when the control link 142 is initially moved from its position shown in FIG. 4 to an over-toggle position, either automatically in response to actuation of striker rods 164*a*, 164*b* and 164*c*, or in response to manual actuation of the reset lever 176, the control link 140 does not immediately respond to initial movement of the control link 142.

During arming of the toggle linkage arrangement 116 as aforedescribed wherein the toggle links 150*a*, 150*b* are moved from their positions as shown in FIG. 5 to their positions as shown in FIG. 4, an annular wheel or roller 186 carried by the pivot pin 156 is moved vertically. Such upward movement of roller 186 effects upward movement of a plunger rod 188 which extends upwardly through a cylindrical housing 190 fixed in upstanding relation on a mounting plate 192 secured to a mounting flange 112*a* on the mounting plate 112 so that the longitudinal axis of plunger 188 is generally radial to the center axis of roller 186. A coil compression spring 194 of predetermined spring rate is disposed within the cylindrical housing 190 such that the upper end of the compression spring abuts the upper end of the housing 190 and the lower end of the spring abuts a spacer 196 fixed on the plunger 188 by a roll pin 198. The compression spring 94 is selected so that upward movement of the plunger 188 effects a predetermined compression of the spring and creates potential energy which acts as a compressive force acting downwardly on the plunger 188 and urging it against the roller 186.

An actuator bar 202 is fixed on the upper end of the plunger 188 and has continual operative association with damping means in the form of a shock absorber 204 having a plunger rod 206 the upper end of which is connected to bar 202. The shock absorber 204 is of conventional design and acts as a dash pot to enable selective control of the downward movement of plunger 188 under the influence of spring 194. The shock absorber or dash pot 204 may, for example, comprise an adjustable shock absorber such as commercially available from Ace Controls, Inc. The shock absorber 204 has an external thread formed on its outer circumferential surface which has threaded cooperation with an internally threaded bore formed in a support bracket 210 mounted on the mounting plate 192 to enable selective positioning of the plunger rod 206 relative to actuator bar 202. A lock nut 212 is provided to fix the adjusted position of shock absorber 204 relative to bracket 210. The rate of downward movement of the plunger 206 is adjustable and thereby facilitates selective adjustability of the rate of downward movement of the plunger 188 by compression spring 194. In this manner, the dash pot 204 is operatively associated with the toggle linkage arrangement 116 and is responsive to initiation of movement of the toggle links 150*a*, 150*b* from their armed to their over-toggle positions so as to effect a predetermined time delay between initial movement of links 150*a*, 150*b* and complete actuation thereof to release the latch lever 96.

In operation, and with the switch transfer mechanism 40 armed and spring 194 compressed from arming of the toggle linkage arrangement 116 as aforedescribed, rotation of pivot shaft 168 and associated trip lever 170 in a counterclockwise direction, as considered in FIG. 4, in response to detection of an overload or fault current and projection of an actuating pin 162 from one of the fuses 44 causes the trip lever to move the toggle links 150*a*, 150*b* to an over-toggle position. At this moment, the compression spring 194 biases the plunger rod 188 downwardly against the roller 186 to urge the pivot pin 148 and control link 142 in a direction toward pivot pin 132. The rate of downward movement of plunger 188 is controlled by the setting of the dash pot or shock absorber 204 so as to effect a controlled time delayed longitudinal movement of the control link 142 toward control link 140 or, stated alternatively, in a release direction. The slots 146 in control link 140 and the positioning of pin 144*a* is such that initial movement of the control link 142 is not transmitted to control link 140, thus establishing an additional time delay between detection of the current overload and release of the latch lever 96.

As the plunger 188 continues to collapse the toggle links 150*a*, 150*b* in time controlled relation, the pin 144*a* eventually reaches the end of slots 146 and transmits movement of the control link 142 to and through control link 140 to move the toggle links 130*a*, 130*b* to an over-toggle position sufficient to lift the latch lever 96 and release it from ratchet tooth 98, thus enabling snap-action movement of the switch contacts 30 to open circuit positions. The fully collapsed or release position of toggle links 150*a*, 150*b* is established by engagement of link 154 with stop pin 160, as illustrated in FIG. 5.

In a similar manner, when it is desired to manually initiate transfer of the switch contacts 30 from their closed to their open circuit relation with fixed contacts 58, and again assuming the switch transfer mechanism 40 to be armed and the power spring 78 compressed from arming of the toggle linkage arrangement 116, the operator may rotate the arming or reset lever 176 in a direction to engage the actuating rod 180 with pin 144*a* and force the toggle links 150*a*, 150*b* to an over-toggle position, thus enabling the plunger 188 to collapse the toggle links 150*a*, 150*b* under the control of the time delay dash pot 204 and move the control link 142 sufficiently to effect release of the latch lever 96 and allow transfer of the switch contacts 30.

Thus, in accordance with the present invention, a relatively inexpensive and highly efficient mechanical time delay mechanism is provided in conjunction with a high voltage switch so as to enable a selective time delay between either manual or automatic actuation of a switch transfer trip mechanism and actual opening of associated switch contacts.

While a preferred embodiment of the invention has been illustrated and described, it will be understood that changes and modifications may be made therein without departing from the invention in its broader aspects. Various features of the invention are defined in the following claims.

What is claimed is:

1. In electrical switch apparatus including at least one pair of relatively movable switch contacts adapted for connection in an electrical circuit and operative between open and closed circuit conditions, switch transfer means operatively associated with at least one of said pair of contacts and operative between a first stored energy condition and a second condition enabling release of said stored energy so as to effect transfer of said switch contacts between said open and closed circuit conditions, and control means operatively associated with said switch transfer means and including a latching lever selectively operable between a latching position maintaining said switch transfer means in said first energy storing condition and a release position enabling release of said stored-energy to cause said transfer of said switch contacts between said open and closed circuit conditions; the combination therewith comprising mechanical time delay means including linkage means operatively associated with said latch lever and having at least one toggle linkage movable between an armed condition operative to maintain said latch lever in its said latching position and a release condition releasing said latch lever from its said latching position, a mechanical time delay operatively associated with said toggle linkage and directly responsive to initiation of movement of said toggle linkage from its said armed condition toward its said released condition so as to effect a predetermined time delay between initial movement of said toggle linkage and complete actuation thereof so as to release said latch lever, and actuator means for initiating movement of said toggle linkage from its said armed to its said released condition.

2. The combination as defined in claim 1 wherein said mechanical time delay includes a plunger having direct contact with said toggle linkage and movable in response to movement of said toggle linkage to its said armed condition, and spring means cooperative with said plunger and adapted to be compressed to create potential energy when said toggle linkage is moved to its said armed condition, said plunger and spring means being operative on said toggle linkage to urge it toward its said released condition upon initiating movement of said toggle linkage by said actuator means, and damping means cooperative with said plunger and spring means so as to control the rate of release of energy by said spring means to said toggle linkage.

3. The combination as defined in claim 2 wherein said damping means is adapted for adjustment to selectively vary the rate of release of energy from said spring means to said toggle linkage to urge said toggle linkage to its said released condition.

4. The combination as defined in claim 1 wherein said toggle linkage defines a first pair of pivotally connected toggle links adapted for movement between armed and over-toggle positions, and control link means interconnected between said toggle links and said latch lever so that movement of said toggle links to their said over-toggle positions is operative to effect movement of said control link in a manner to release said latch lever.

5. The combination as defined in claim 1 wherein said actuator means comprises a manually operable actuator operative to move said toggle linkage to its said armed condition, said actuator being manually operative to initiate movement of said toggle to its said released condition so as to enable selective manual transfer of said switch contacts between closed to open circuit conditions.

6. The combination as defined in claim 1 wherein said switch apparatus includes at least one fuse connected in circuit with said switch contacts and having a projectile therein adapted to be projected from said fuse when said fuse is subjected to a predetermined circuit overload or fault current, and including a striker rod supported so as to be engaged by said projectile when projected from said fuse, said striker rod being cooperable with said toggle linkage so as to automatically initiate movement of said toggle linkage to its said released condition upon detection by said fuse of said predetermined overload or fault current.

7. The combination as defined in claim 1 wherein said linkage means includes a lost motion control linkage adapted to effect an additional time delay between said initiation of movement of said toggle linkage and release of said latch lever to effect transfer of said switch contacts.

8. In electrical switch apparatus including at least one pair of relatively movable switch contacts adapted for connection in an electrical circuit and operative between open and closed circuit conditions, switch transfer means operatively associated with at least one of said pair of contacts and operative between a first stored energy condition and a second condition enabling release of said stored energy so as to effect transfer of said switch contacts between said open and closed circuit conditions, and control means operatively associated with said switch transfer means and including a latching lever selectively operable between a latching position maintaining said switch transfer means in said first energy storing condition and a release position enabling release of said stored energy to cause said transfer of said switch contacts between said open and closed circuit conditions; the combination therewith comprising mechanical time delay means including a first pair of pivotally connected toggle links adapted for movement between armed and over-toggle positions, a second pair of pivotally connected toggle links disposed substantially parallel to said first pair of toggle links, control link means interconnecting said first and second pairs of toggle links, said second pair of toggle links having direct connection with said latch lever so that movement of said first pair of toggle links to its over-toggle positions is operative to release said latch lever from its said latching position, means operatively associated with said first pair of toggle links and responsive to initiation of movement thereof to effect a predetermined time delay between initial movement of said first toggle links and complete actuation thereof so as to relase said latch lever, and actuator means for initiating movement of said first pair of toggle links from its said armed to its said released condition.

9. In a switch mechanism, the combination comprising first and second contacts adapted for connection in an electrical circuit and at least one of which is movable relative to the other between open and closed circuit relation therewith, a locking plate operatively associated with said movable contact and movable therewith, a cocking lever movable between first and second positions relative to said locking plate, means operatively interconnecting said cocking lever and said locking plate and adapted to be placed in a potential energy storing condition when said cocking lever is moved between its said first and second positions with said locking plate and associated contact maintained in fixed relation to the other of said contacts, a latch lever operatively associated with said locking plate and operative between a first position retaining said locking plate in said fixed relation with said other of said contacts and a second position enabling movement of said locking plate and associated switch contact relative to said other of said contacts in response to release of said stored potential energy, and mechanical time delay means operatively associated with said latch lever and adapted to maintain said latch lever in its said first position and effect selective movement thereof to its said second position in response to a predetermined event, said time delay means including a toggle linkage arrangement operatively connected to said latch lever and having a pair of toggle links movable between an armed condition preventing movement of said latch lever to its said second position and a released condition effecting movement of said latch lever to its said second position, a mechanical time delay operatively associated with said toggle links and directly responsive to initiation of movement of said toggle links from said armed condition toward said released condition so as to effect a predetermined time delay between initial movement of said toggle links from said armed condition to said released condition, and actuator means operatively associated with said pair of toggle links and responsive to said predetermined event to initiate movement of said toggle links from said armed to said released condition.

10. The combination as defined in claim 9 wherein said toggle links comprise a first pair of pivotally connected toggle links adapted for movement between armed and over-toggle positions, and including control linkage means interconnected between said first pair of toggle links and said latch lever so that movement of said toggle links to their said over-toggle positions is operative to effect movement of said control linkage means in a manner to release said latch lever.

11. The combination as defined in claim 10 wherein said toggle linkage arrangement includes a second pair of pivotally connected toggle links disposed substantially parallel to said first pair of toggle links and interconnected thereto through said control linkage means, said second pair of toggle links having direct connection with said latch lever and being responsive to movement of said control linkage means to release said latch lever from its said latching position.

12. The combination as defined in claim 11 wherein said control linkage means includes a pair of control links interconnected through a lost motion connection so as to effect an additional time delay between said initiation of movement of said linkage arrangement and release of said latch lever to effect transfer of said switch contacts.

13. The combination as defined in claim 10 wherein said mechanical time delay includes a plunger having direct engagement with said toggle links and movable in response to movement of said toggle links to its said armed condition, and spring means cooperative with said plunger and adapted to be compressed to create potential energy when said toggle links are moved to their said armed positions, said plunger and spring means being operative on said toggle links to urge them to their said over-toggle condition upon initiating movement of said toggle links by said actuator means, and damping means cooperative with said plunger and spring means so as to control the rate of release of energy by said spring means to said first pair of toggle links.

14. The combination as defined in claim 13 wherein said damping means is adapted for adjustment to selectively vary the rate of release of energy from said spring means to said pair of toggle links to urge said toggle links to their said over-toggle condition.

15. The combination as defined in claim 9 wherein said actuator means comprises a manually operable actuator operative to move said toggle links to said armed condition, said actuator being manually operative to initiate movement of said toggle links to said released condition so as to enable selective manual transfer of said switch contacts between closed to open circuit conditions.

16. The combination as defined in claim 9 wherein said switch apparatus includes at least one fuse connected in circuit with said switch contacts and having a projectile therein adapted to be projected from said fuse when said fuse is subjected to a predetermined circuit overload or fault current, and including a striker rod supported so as to be engaged by said projectile when projected from said fuse, said striker rod being cooperable with said toggle linkage arrangement so as to automatically initiate movement of said toggle links to said released condition upon detection by said fuse of said predetermined overload or fault current.

* * * * *

UNITED STATES PATENT AND TRADEMARK OFFICE

CERTIFICATE OF CORRECTION

PATENT NO. : 4,297,554

DATED : October 27, 1981

INVENTOR(S) : William R. Rueth, Jr.

It is certified that error appears in the above—identified patent and that said Letters Patent is hereby corrected as shown below:

Column 8, line 61, "94" should be --194--.

Column 10, line 35, Claim 1, "stored- energy" should be --stored energy--.

Column 11, line 16, Claim 5, "toggle to" should be --toggle linkage to--.

Signed and Sealed this

*Ninth* Day of *March 1982*

[SEAL]

*Attest:*

GERALD J. MOSSINGHOFF

*Attesting Officer* *Commissioner of Patents and Trademarks*